United States Patent [19]

Auerbach

[11] Patent Number: 4,911,422

[45] Date of Patent: Mar. 27, 1990

[54] INSERTER REJECT STATION

[75] Inventor: David R. Auerbach, West Redding, Conn.

[73] Assignee: Pitney Bowes Inc., Stamford, Conn.

[21] Appl. No.: 287,250

[22] Filed: Dec. 21, 1988

[51] Int. Cl.[4] ..... B65H 5/00; B65H 3/06

[52] U.S. Cl. ..... 271/225; 271/2; 271/118; 271/184; 271/312

[58] Field of Search ..... 271/2, 37, 115, 118, 271/184, 185, 225, 298, 302–304, 307, 308, 312

[56] References Cited

U.S. PATENT DOCUMENTS

| | | | |
|---|---|---|---|
| 4,051,957 | 10/1977 | Parups | 271/184 |
| 4,061,329 | 12/1977 | Garavuso | 271/184 |
| 4,657,466 | 4/1987 | Leeper et al. | 271/312 |
| 4,756,521 | 7/1988 | Martin | 271/225 |

FOREIGN PATENT DOCUMENTS

| | | | |
|---|---|---|---|
| 573694 | 2/1958 | Italy | 271/184 |
| 637900 | 8/1983 | Switzerland | 271/184 |

OTHER PUBLICATIONS

Garrison, S. P., "Composite Back Up Pad", *IBM Technical Disclosure Bulletin,* vol. 23, No. 10 (3/81), p. 4794.

*Primary Examiner*—Joseph J. Rolla
*Assistant Examiner*—Steve Reiss
*Attorney, Agent, or Firm*—Charles R. Malandra, Jr.; Melvin J. Scolnick; David E. Pitchenik

[57] ABSTRACT

Apparatus for removing a flat article form a stream of articles moving along a straight path. The apparatus includes: a substantially curved, horizontal ramp movable vertically between a lower, home position and an upper position for engaging a removing the flat article form the stream and a swingable arm situated above the ramp. The arm has at its remote end a constantly turning roller and an arc, such that the constantly turning roller is always situated above the horizontal ramp. The path further included is a device for moving the ramp form the lower position to the upper position to engage the constantly turning roller to thereby drive the roller toward the flat article whereby the flat article is gripped by the constantly turning roller and removed form the stream of flat articles.

10 Claims, 5 Drawing Sheets

12
22
24
14
16
10
33
99
42
38
37
30
35
31
99
34
32
39

INSERTER REJECT STATION

BACKGROUND OF THE INVENTION

The instant invention relates generally to envelope inserting and turning apparatus and more particularly to a reject station associated with an envelope inserter and turner. Machines for inserting documents and the like into envelopes are well known. These inserting machines are typically associated with an in-line mailing machine located downstream which prints the requisite postage on the stuffed envelope. However, prior to the postage being printed, it is usually necessary to turn the envelope 90 degrees or 180 degrees depending on the configuration of the metering equipment in relation to the inserting equipment. If the postage meter is oriented in the same direction as the discharge from the inserting equipment, a turn of 90 degrees is required for the envelope; if the postage meter is oriented 90 degrees to the direction of the inserting equipment, a turn of 180 degrees is required by the envelope.

It sometimes happens that an envelope that is intended to be stuffed does not get opened and thus contains no inserts. It is also a fact that in the course of the inserting process, some envelopes become damaged. It then becomes necessary to remove these unopened or damaged envelopes from the flow of envelopes so that they do not reach the postage meter and further processing. One of the best places to reject unopened or damaged envelopes is between the inserter and envelope turner at a location perpendicular to the centerline of the mail path. The best time to do the rejecting is after the envelope is transported out of the insertion area and before the turning cycle is started.

Accordingly, the instant invention provides a rejection device in accordance with the foregoing criteria for envelopes which have been discharged from an insertion machine prior to their being engaged by a turner for turning to proper orientation for the printing of postage thereon.

SUMMARY OF THE INVENTION

The instant invention therefore provides apparatus for removing a flat article from a stream of articles moving along a straight path. The apparatus includes: a substantially curved, horizontal ramp movable vertically between a lower, home position and an upper position for engaging and removing the flat article from the stream; a swingable arm situated above the ramp, the arm having at its remote end a constantly turning roller, the arm having an arc such that the constantly turning roller is always situated above the horizontal ramp, the roller having a home position remote from the straight path; and a device for moving the ramp from the lower position to the upper position to engate the constantly turning roller to thereby drive the roller toward the flat article whereby the flat article is gripped by the constantly turning roller and removed from the stream of flat articles.

BRIEF DESCRIPTION OF THE DRAWINGS

FIG. 3 is similar to FIG. 1 but shows the movable take-off ramp raised and the swingable arm and roller situated above the ramp rolling toward the envelope about to be rejected;

DETAILED DESCRIPTION

Figure 1:
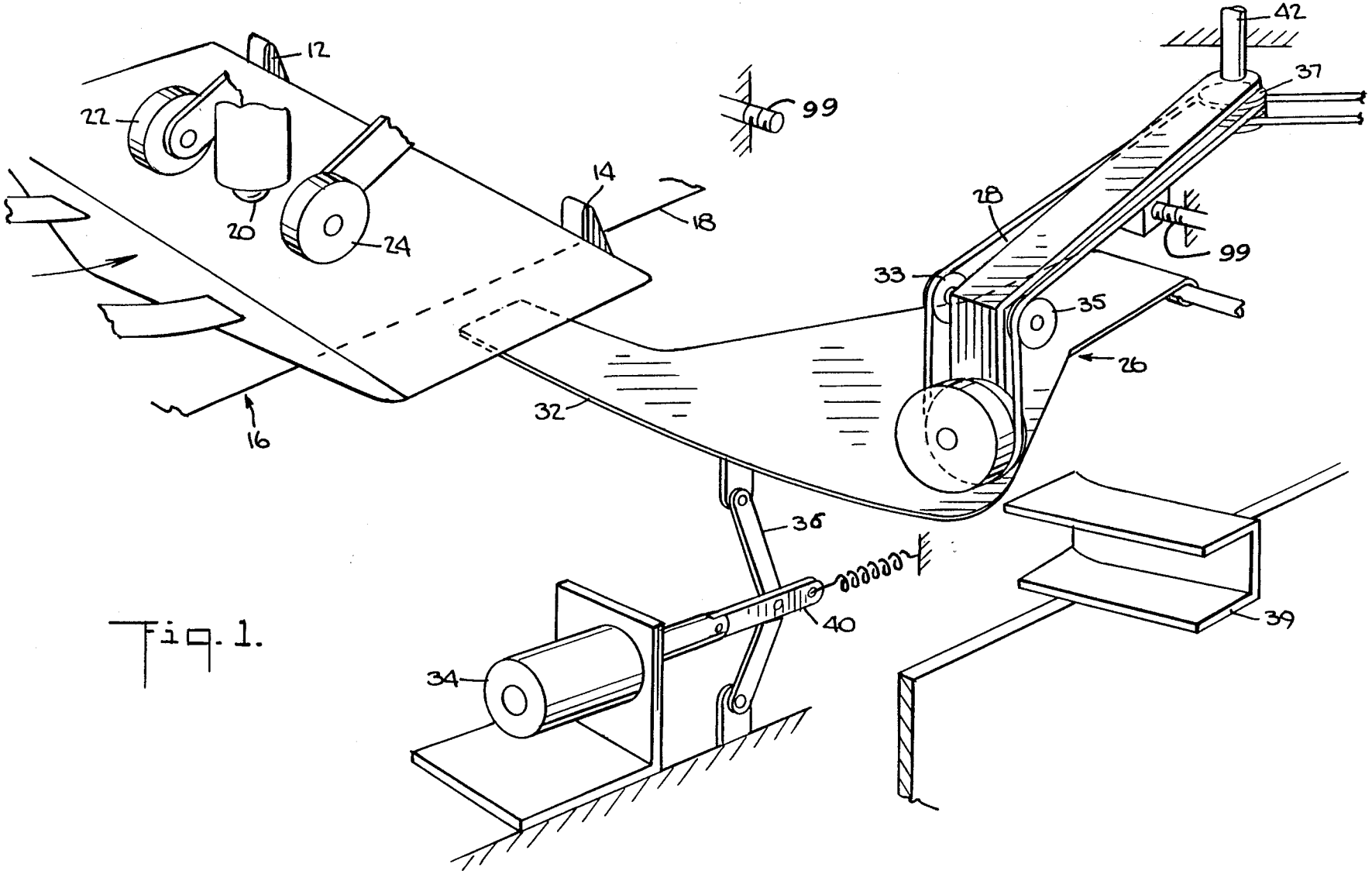
FIG. 1 is a perspective view of an envelope reject apparatus in accordance with the instant invention and shows an envelope positioned against the stops of an envelope turner.

In describing the preferred embodiment of the instant invention, reference is made to the drawings, wherein there is seen in FIG. 1 an envelope 10 which has just emerged from an inserting machine (not shown) and has been stopped by a pair of adjustable, vertically movable, registration stops 12 and 14 which are part of an envelope turning device generally designated 16. The envelope turner 16 may be of any conventional design, but in the preferred embodiment includes a deck 18 and a biased pivot ball 20 which cooperates with elements (not seen) beneath the deck 18 to turn the envelope 10 as desired. For a detailed description of the turner 16, reference should be made to co-pending application Ser. No. 279,000 filed 12-2-199 in the name of David R. Auerbach and assigned to the assignee of the instant invention. The turner 16 further includes a pair of feed rollers 22 and 24 for urging the envelope 10 against the registration stops 12 and 14.

As seen in FIG. 1, there is situated adjacent the path of the envelope 10 and turner 16, but not in the path of the envelope 10, a rejecting device generally designated 26 for removing envelopes which should not be processed further, such as those which were damaged or never opened for the insertion of documents. The rejection device 26 includes a swinging arm 28 at the end of which is a soft, constantly turning roller 30. The roller 30 is rotated by means of a driven belt 31 which is trained over pulleys 33, 35 and 37. The belt 31 is driven by a conventional motor (not shown). The home position, shown in FIG. 1, of the roller 30 is out of the path of the envelope 10. Positioned under the roller 30 is a curved, horizontal ramp 32 that can move up and down by the action of a solenoid 34 through linkage 36. The curve of the ramp 32 is such that when the arm 28 swings through its travel as seen in FIG. 3, the ramp 32 will always be below the turning roller 30. The end portion 38 of the ramp 32 extends sufficiently into the path of the envelope 10 so that it will lie beneath the side portion of even the smallest envelope 10 that the turner 16 will handle.

Figure 5:
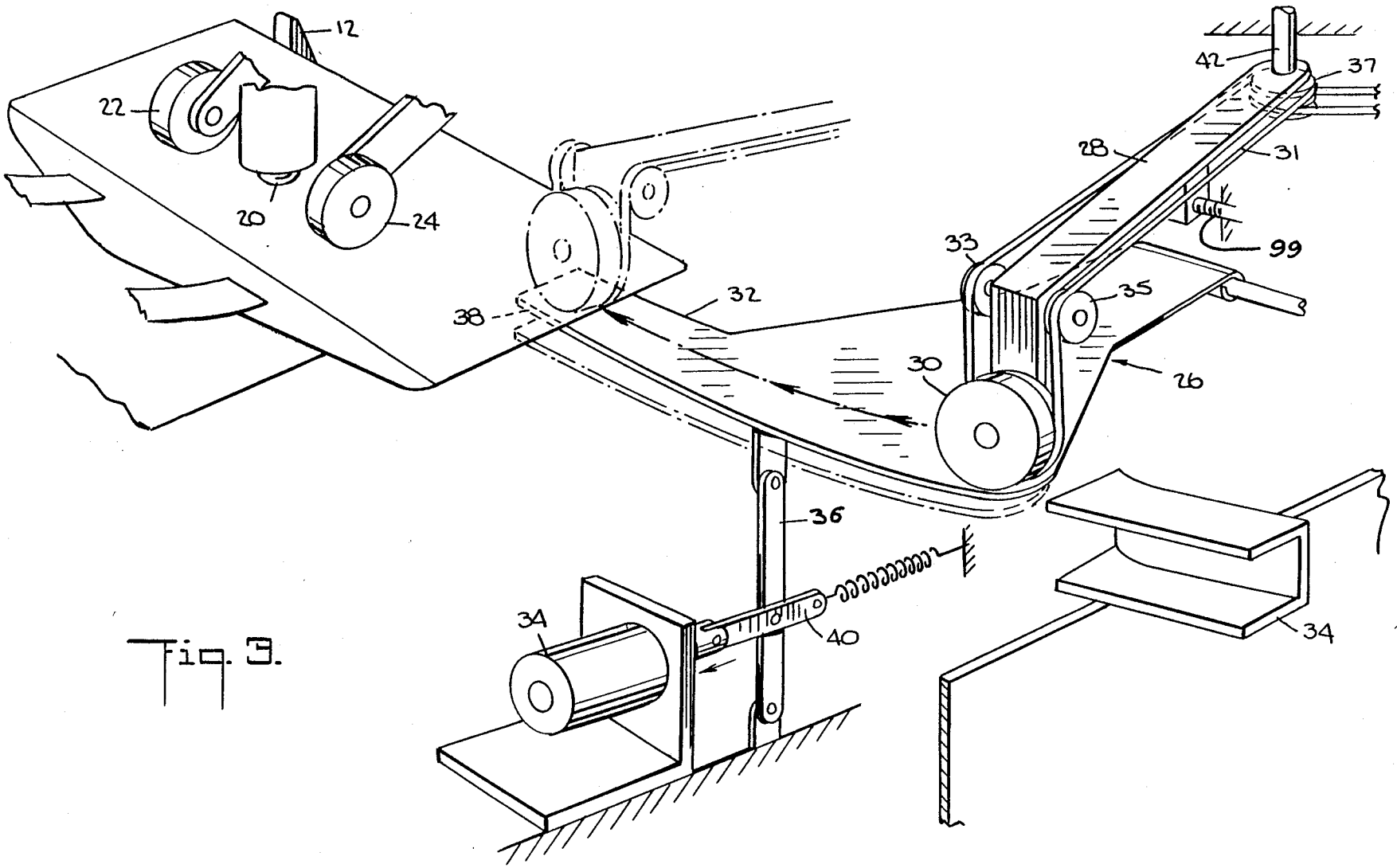
FIG. 5 is a side elevational view showing an envelope about to be rejected and the take-off ramp in its lowered position.
Figure 6:
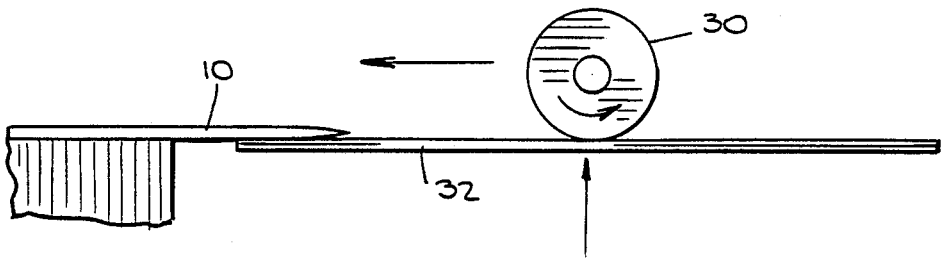
FIG. 6 is similar to FIG. 5 but the ramp has now been raised and has engaged the roller which is seen rolling toward the envelope.

When it is desired to reject an envelope 10, the solenoid 34 is activated by conventional circuitry associated with the inserter and turner 16. The solenoid 34 then lifts the ramp 32 from the lower position (FIG. 5) to the upper position (FIG. 6) as seen in FIG. 3 by virtue of the solenoid arm 40 straightening the linkage 36; i.e. the arm 40 moves to the left, as seen in FIG. 1, thereby causing the linkage 36 to be moved perpendicular to the arm 40. The height of the ramp 32 is adjusted so that when it is in its raised position, the turning roller 30 engages the ramp 32, which provides the frictional force and hence power to swing the arm 28 in the direction of the envelope 10 which is situated in the turner 16 and resting against the registration stops 12 and 14.

Figure 2:
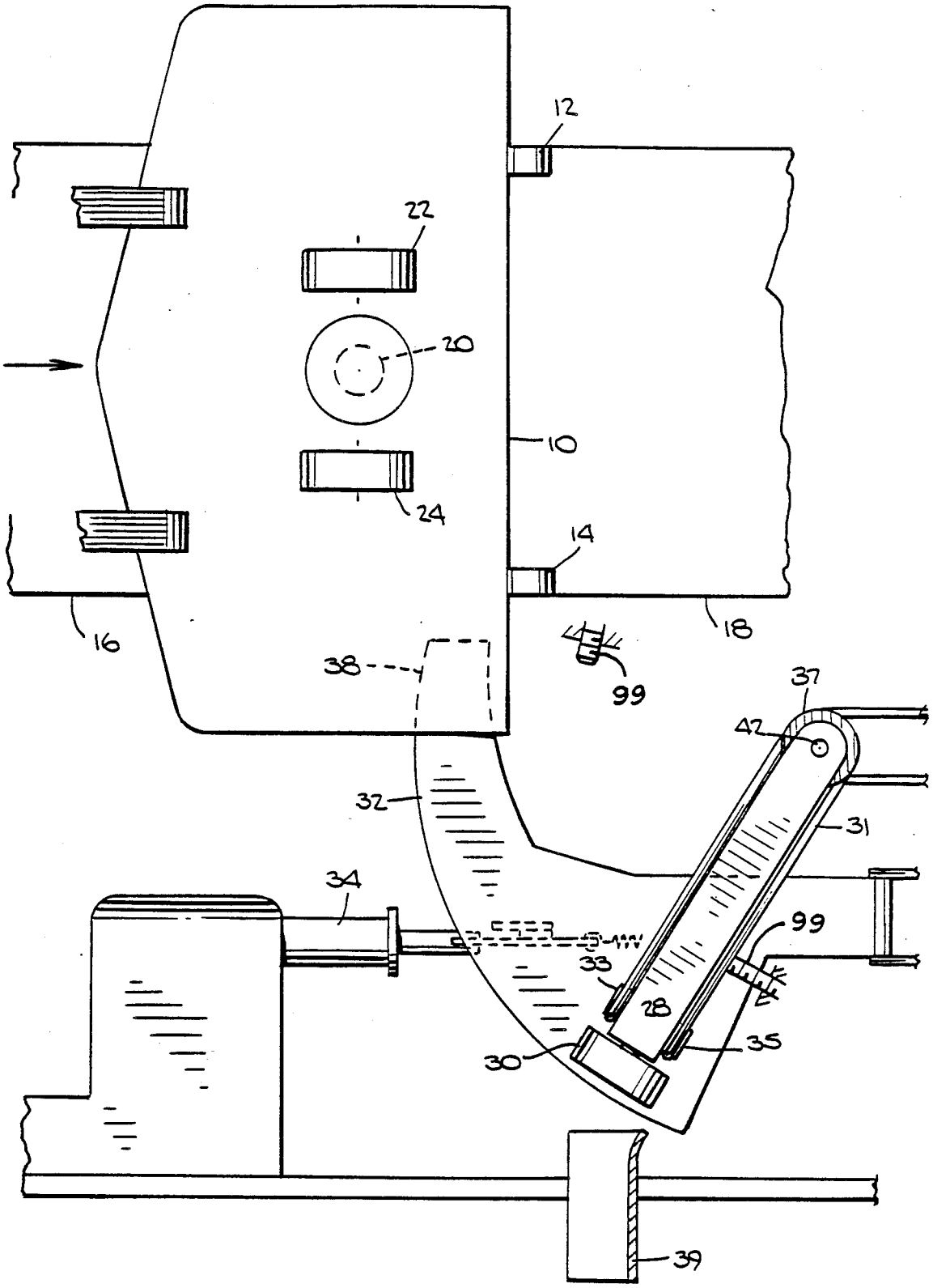
FIG. 2 is a plan view of the apparatus seen in FIG. 1.
Figure 4:
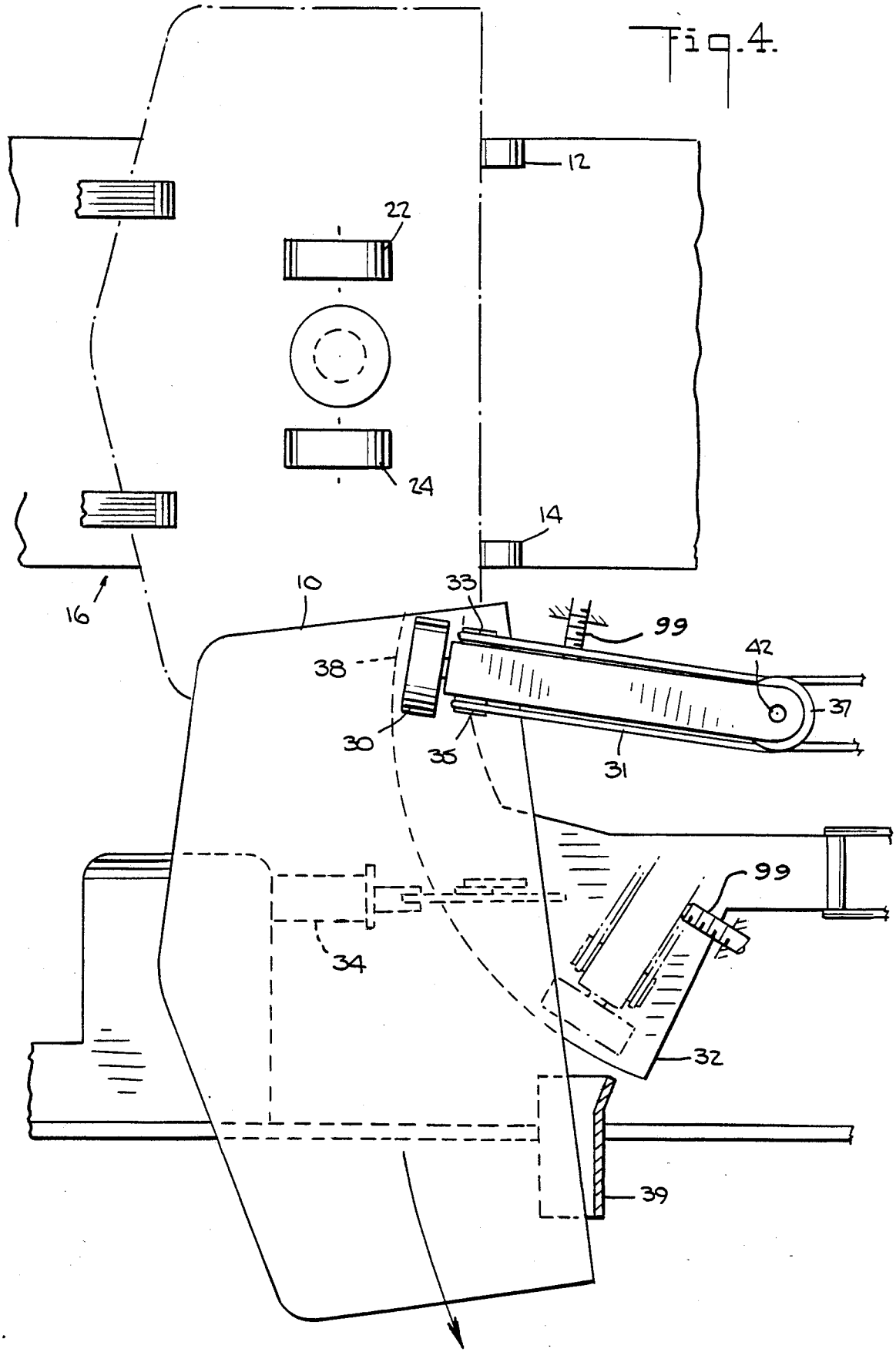
FIG. 4 is a plan view of the apparatus seen in FIG. 1 and shows the swingable arm and roller removing the envelope from the path of travel leading to the envelope turner.
Figure 5:
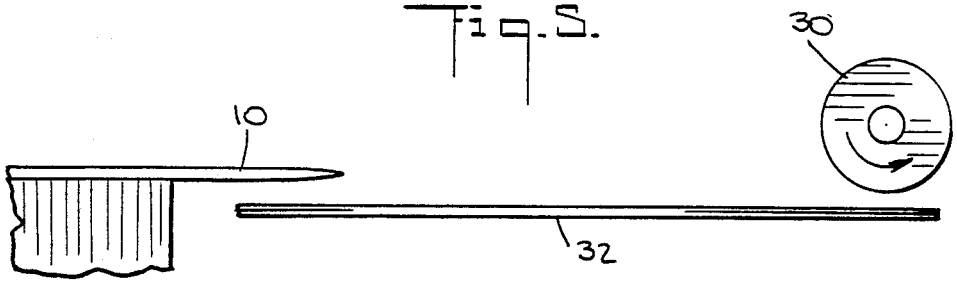
Figure 7:
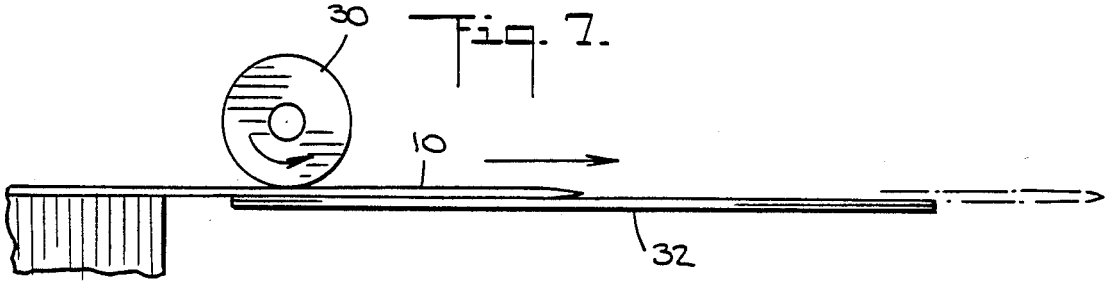
FIG. 7 is similar to FIG. 6 but shows the roller on top of and engaging the envelope to thereby move the envelope out of the path of travel leading to the envelope turner.
Figure 8:
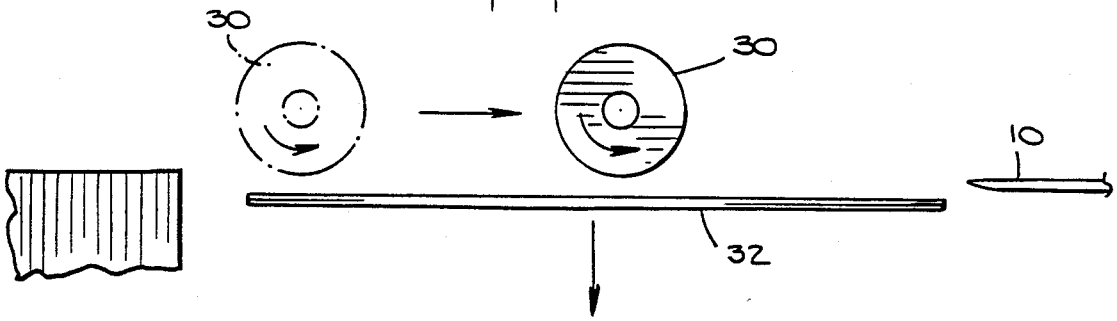
FIG. 8 is similar to FIG. 7 but shows the envelope removed from the path of travel and the ramp has been lowered to its home position.

The moving arm 28 will then hit its stop 99, at which time the turning roller 30 grips the envelope 10 (see FIGS. 3 and 7) and sends it off to the side of the path as seen in FIGS. 4 and 7. A guide 39 directs the rejected envelope 10 into a collecting bin (not seen). The solenoid 34 is then de-activated and the ramp 32 drops down to its lower position (see FIG. 8) which allows the arm 28 to return to its home position, as seen in FIGS. 1 and 2. The arm 28 is driven to its home position by the torque of a vertical shaft 42 upon which the arm 28 is rotatably mounted and a bias provided by conventional means (not shown) such as a return spring.

It should be understood by those skilled in the art that various modifications may be made in the present invention without departing from the spirit and scope thereof, as described in the specification and defined in the appended claims.

What is claimed is:

1. Apparatus for removing a flat article from a stream of flat articles moving along a straight path, comprising:

a substantially curved, horizontal ramp movable vertically between a lower, home position and an upper position for engaging and removing said flat article from said stream;

a swingable arm situated above said ramp, said arm having at its remote end a constantly turning roller, said arm having an arc such that the constantly turning roller is always situated above said horizontal ramp, said roller having a home position remote from said straight path; and means for moving said ramp from said lower position to said upper position to engage said constantly turning roller to thereby drive said roller toward said flat article whereby said flat article is gripped by said constantly turning roller and removed from said stream of flat articles.

2. The apparatus of claim 1, wherein said flat article comprises an envelope.

3. The apparatus of claim 2, additionally comprising means for stopping said envelope in said straight path.

4. The apparatus of claim 3, wherein said swingable arm includes a belt for rotating said constantly turning roller.

5. The apparatus of claim 4, wherein said moving means comprises a solenoid.

6. The apparatus of claim 5, additionally comprising a guide for directing an envelope removed from said straight path to a location remote from said straight path.

7. The apparatus of claim 1, additionally comprising means for stopping said flat article in said straight path.

8. The apparatus of claim 1, wherein said swingable arm includes a belt for rotating said constantly turning roller.

9. The apparatus of claim 1, wherein said moving means comprises a solenoid.

10. The apparatus of claim 1, additionally comprising a guide for directing a flat article removed from said straight path to a location remote from said straight path.

* * * * *